US008485994B1

(12) United States Patent
Erb

(10) Patent No.: US 8,485,994 B1
(45) Date of Patent: Jul. 16, 2013

(54) PHYSICAL THERAPY SYSTEM

(76) Inventor: Mark Erb, Menomonie, WI (US)

( * ) Notice: Subject to any disclaimer, the term of this patent is extended or adjusted under 35 U.S.C. 154(b) by 235 days.

(21) Appl. No.: 13/088,149

(22) Filed: Apr. 15, 2011

Related U.S. Application Data

(60) Provisional application No. 61/325,170, filed on Apr. 16, 2010.

(51) Int. Cl.
*A61H 1/00* (2006.01)
*A61H 1/02* (2006.01)
*A61H 5/00* (2006.01)

(52) U.S. Cl.
USPC ..... 601/5; 601/24; 601/33

(58) Field of Classification Search
USPC ..... 601/5, 23, 24, 27, 29, 31, 32, 34, 601/35, 84, 89, 97, 112, 33
See application file for complete search history.

(56) References Cited

U.S. PATENT DOCUMENTS

| | | | | |
|---|---|---|---|---|
| 1,098,326 | A | 5/1914 | Koch | |
| 3,060,926 | A * | 10/1962 | May | 601/35 |
| D237,654 | S | 11/1975 | Agatani | |
| 4,566,440 | A | 1/1986 | Berner et al. | |
| 4,628,909 | A * | 12/1986 | Tietsworth | 601/35 |
| 4,986,261 | A | 1/1991 | Iams et al. | |
| 5,207,216 | A | 5/1993 | Sweeny | |
| 6,821,288 | B2 | 11/2004 | Schaeffer | |
| 2005/0159683 | A1 | 7/2005 | Kuo | |
| 2005/0251067 | A1 * | 11/2005 | Terry | 601/5 |
| 2005/0273022 | A1 * | 12/2005 | Diaz et al. | 601/5 |
| 2006/0211957 | A1 | 9/2006 | Beny et al. | |

* cited by examiner

*Primary Examiner* — Kristen Matter

(57) ABSTRACT

A physical therapy system featuring a leg portion and at least one arm portion, wherein the leg portion comprises a base with two half cylinders, each divided into two portions that can pivot via hinges operatively connected to motors, wherein the two half cylinders can also pivot about their first ends via a first central motor, and wherein the arm portion comprises a base with a half cylinder divided into two portions that can pivot via a hinge operatively connected to a motor, wherein the half cylinder can also pivot about its first end via a second central motor.

16 Claims, 6 Drawing Sheets

PHYSICAL THERAPY SYSTEM

This application claims the benefit of U.S. Provisional Patent Application Ser. No. 61/325,170 filed Apr. 16, 2010, the disclosure of which is incorporated in its entirety by reference herein.

FIELD OF THE INVENTION

Present invention is directed to devices used for physical therapy, more particularly to a system comprising a leg portion and an arm portion that simulates walking.

BACKGROUND OF THE INVENTION

Many individuals suffering from injuries require physical therapy equipment. The present invention features a physical therapy system that simulates walking. A user can lie on his/her back or stomach and place his/her arms in the arm portion and legs in the leg portion. When the system is activated, the arm and leg portions move the user's arms and legs upwardly and downwardly, mimicking walking movements. The system of the present invention can provide users with increased mobility and enhanced circulation. The system may be useful for individuals recovering from an injury, individuals who are overweight, or individual with diabetes. The system may also be used to help perform Pilates swimming exercises, which provide core stabilization, provide back and hip extension, and improve back strength.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Referring now to FIGS. 1-7, the present invention features a physical therapy system that simulates walking. The system comprises a leg portion 100*a* and one or two arm portions 100*b* (e.g., One for each arm).

Referring now to FIGS. 1-6, the leg portion 100*a* comprises a first base 110 having a top surface, a bottom surface, a first side edge, a second side edge opposite the first side edge, a third side edge, and a fourth side edge opposite the third side edge.

Figure 1:
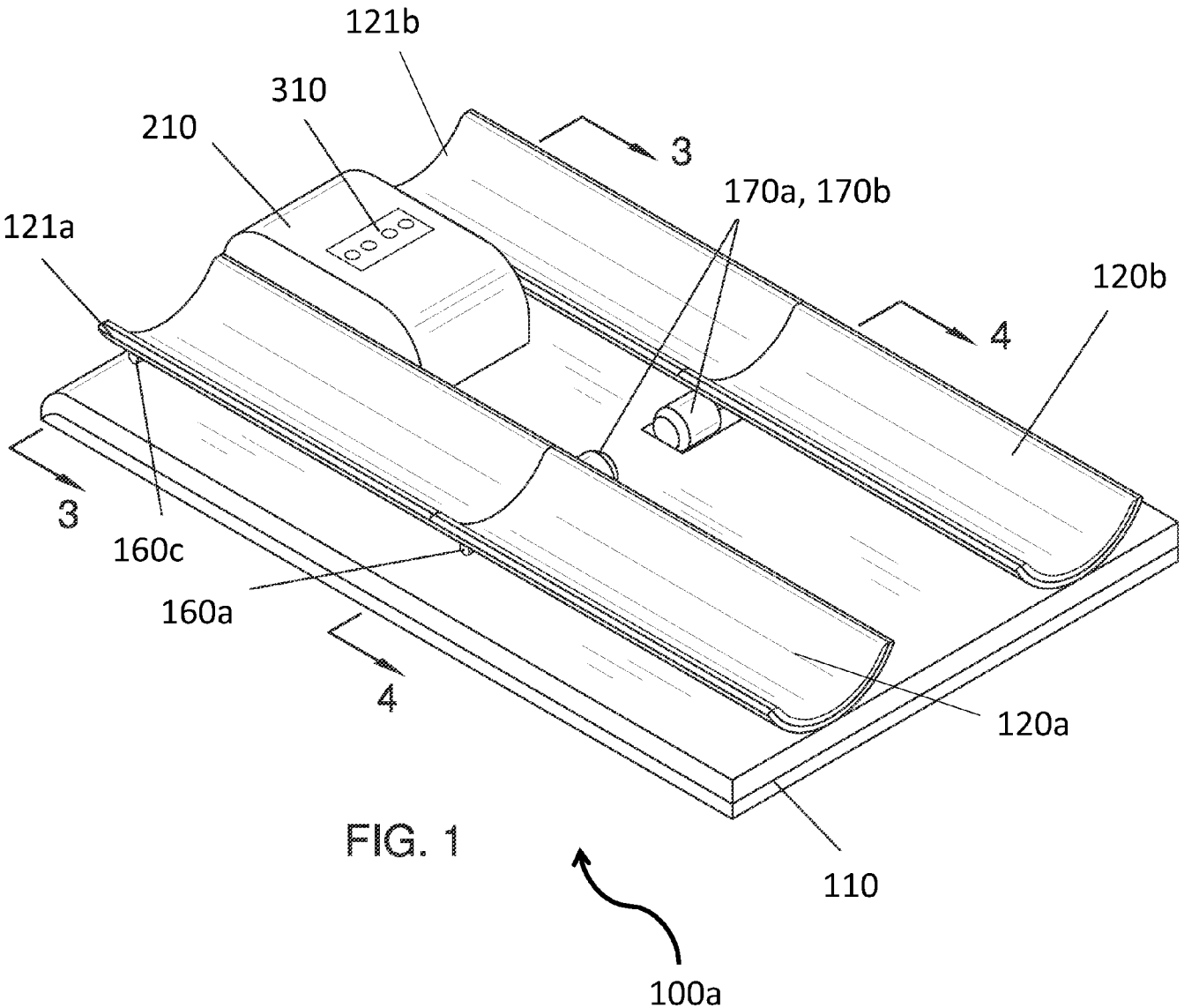
FIG. 1 is a perspective view of a leg portion of the physical therapy system of the present invention.
Figure 2:
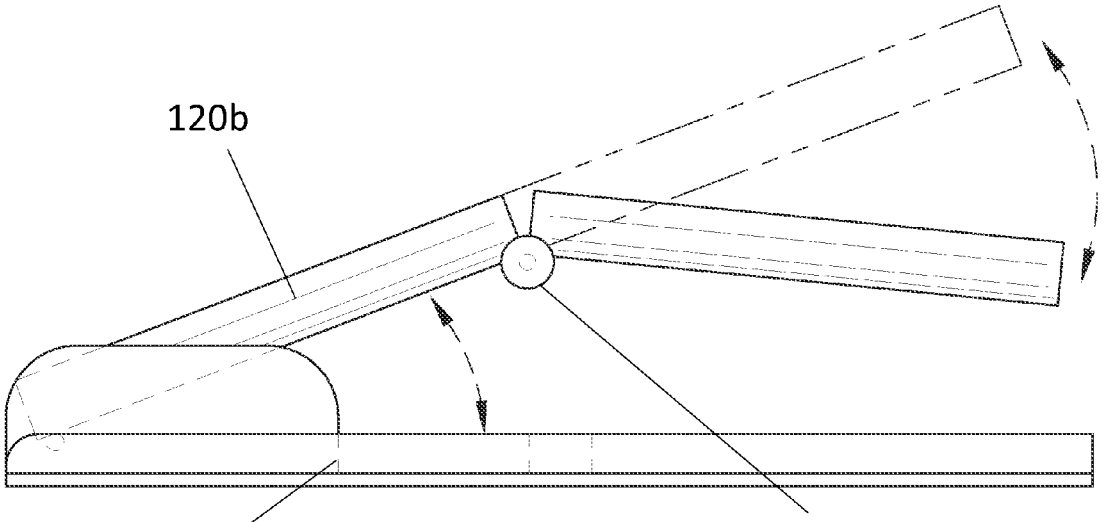
FIG. 2 is a side view of the leg portion of FIG. 1.
Figure 3:
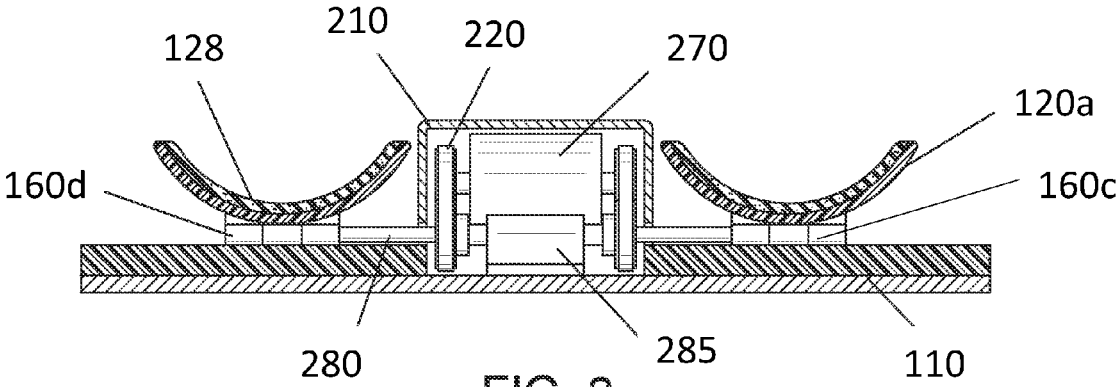
FIG. 3 is a first front cross sectional view of the leg portion of FIG. 1.

Disposed on the top surface of the first base is a pair of parallel half cylinders, for example a first half cylinder 120*a* and a second half cylinder 120*b*. As shown in FIG. 1, the first half cylinder 120*a* is positioned near the first side edge of the first base 110 and extends from near the third side edge to near the fourth side edge. The first end 121*a* of the first half cylinder 120*a* is positioned near the third side edge. The second half cylinder 120*b* is positioned near the second side edge of the first base 110 and extends from near the third side edge to near the fourth side edge. The first end 121*b* of the second half cylinder 120*b* is positioned near the third side edge.

The first half cylinder 120*a* and the second half cylinder 120*b* are adapted to cradle a user's legs. The first half cylinder 120*a* is divided into a first portion and a second portion, the portions being pivotally connected via a first hinge 160*a*. The second half cylinder 120*b* is divided into a first portion and a second portion, the portions being pivotally connected via a second hinge 160*b*. The first hinge 1605 and the second hinge 160*b* are positioned on the half cylinders 120 such that the back surfaces of the portions of the half cylinders 120 move toward each other as opposed to the top surfaces of the portions of the half cylinders 120 moving towards each other. Generally, a user places his/her legs in the half cylinders 120 and positions his knees over the first and second hinges. The pivoting of the half cylinders 120 allows the user's legs to be bent at the knees.

Figure 4:
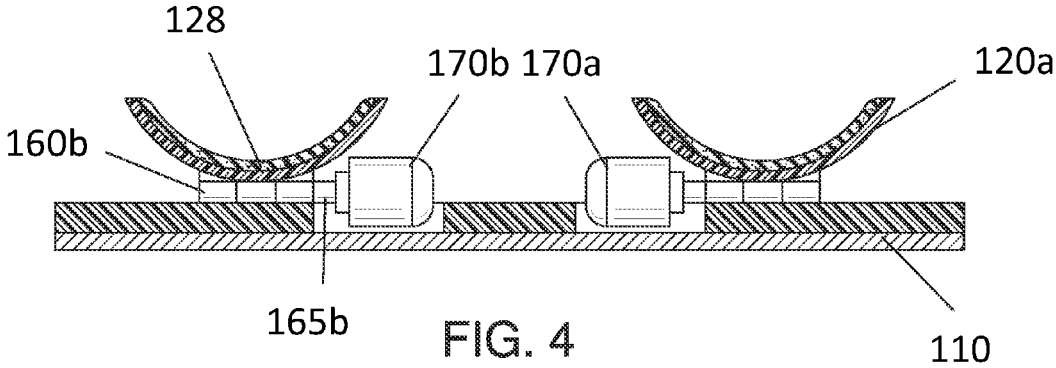
FIG. 4 is a second front cross sectional view of the leg portion of FIG. 1.
Figure 5:
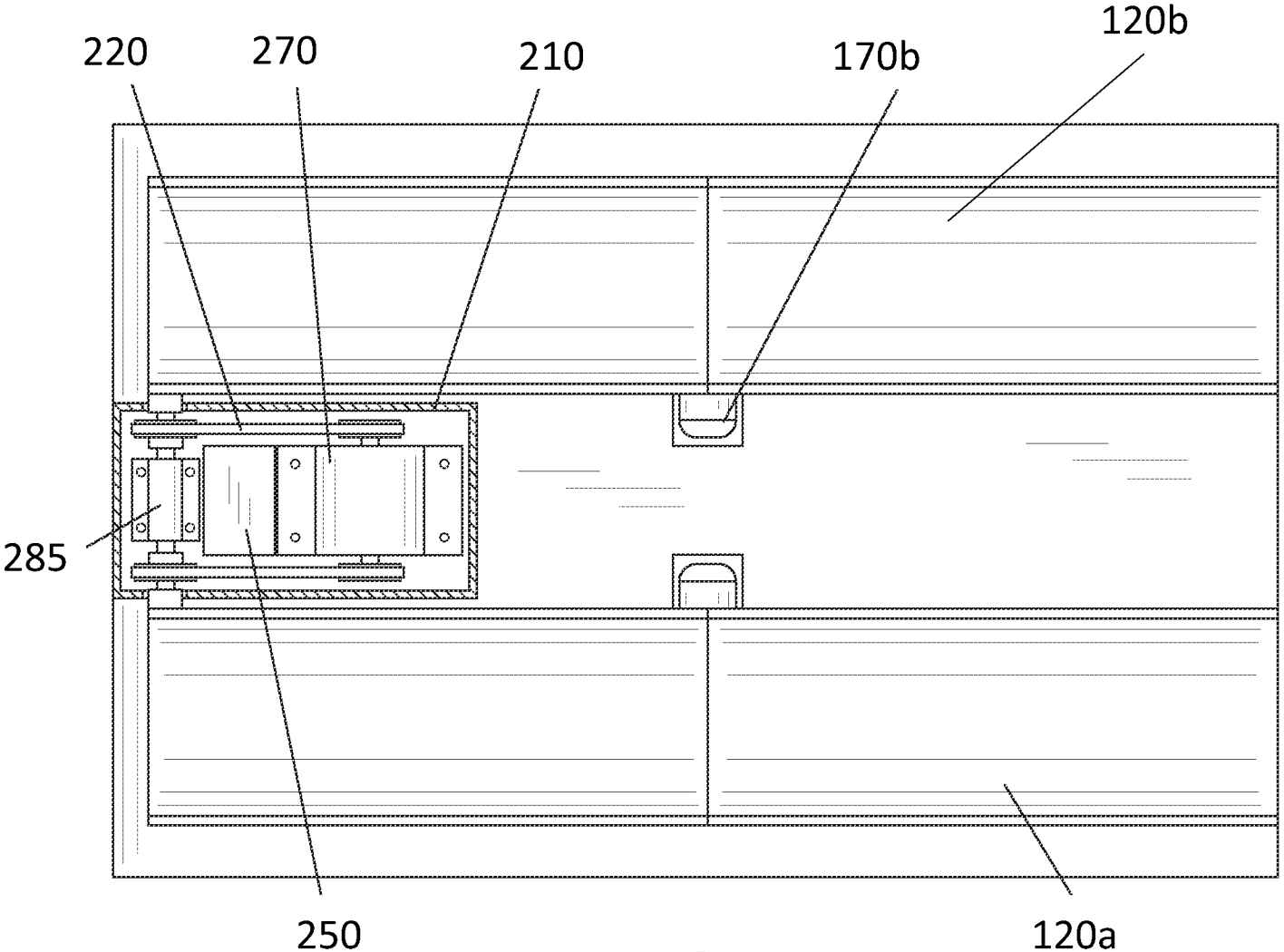
FIG. 5 is a top and internal view of the leg portion of FIG. 1.

As shown in FIG. 4, the first hinge 160*a* is operatively connected to a first hinge motor 170*a* (e.g., via a first hinge shaft), and the second hinge 160*b* is operatively connected to a second hinge motor 170*b* (e.g., via a second hinge shaft 165*b*). The hinge motors 170 each function to pivot the half cylinders 120 about the first and second hinges, respectively. In some embodiments, the hinges 1602, 160*b* and/or hinge motors 170*a*, 170*b* may be temporarily disposed in a slot 190 disposed in the top surface of the base 110. The slot 190 may help keep the half cylinders 120 flush with the base 110 when not in use.

In some embodiments, the half cylinders 120 are covered with a soft material 128, for example foam (e.g., dense foam, light foam), fabric, the like, or a combination thereof. The soft material 128 can provide comfort to the user when placing his/her legs in the half cylinders 120.

The first end 121*a* of the first half cylinder 120*a* is pivotally attached to the base 110 via a third hinge 160*c*. The first end 121*b* of the second half cylinder is pivotally attached to the base 110 via a fourth hinge 160*d*. The half cylinders 120 can pivot upwardly and downwardly with respect to the base 110 via the third and fourth hinges. The pivoting of the half cylinders 120 about the third and fourth hinges is controlled via a central motor 270.

The third hinge 160*c* and fourth hinge 160*d* are both connected to the central motor 270 via a hinge shaft 280. For example, the first end of the hinge shaft 280 engages the third hinge 160*c* and the second end of the hinge shaft 280 engages the fourth hinge 160*d*. The hinge shaft 280 is operatively connected to the central motor 270. The central motor 270 is enclosed in a housing 210. In some embodiments, the housing 210 is positioned in between the first half cylinder 120*a* and the second half cylinder 120*b*, although the present invention is not limited to this configuration.

The first hinge motor 170*a*, the second hinge motor 170*b*, and/or the central motor 270 may be standard motors or hydraulic motors. Such motors are well known to one of ordinary skill in the art. The present invention is not limited to standard and hydraulic motors.

Figure 6:
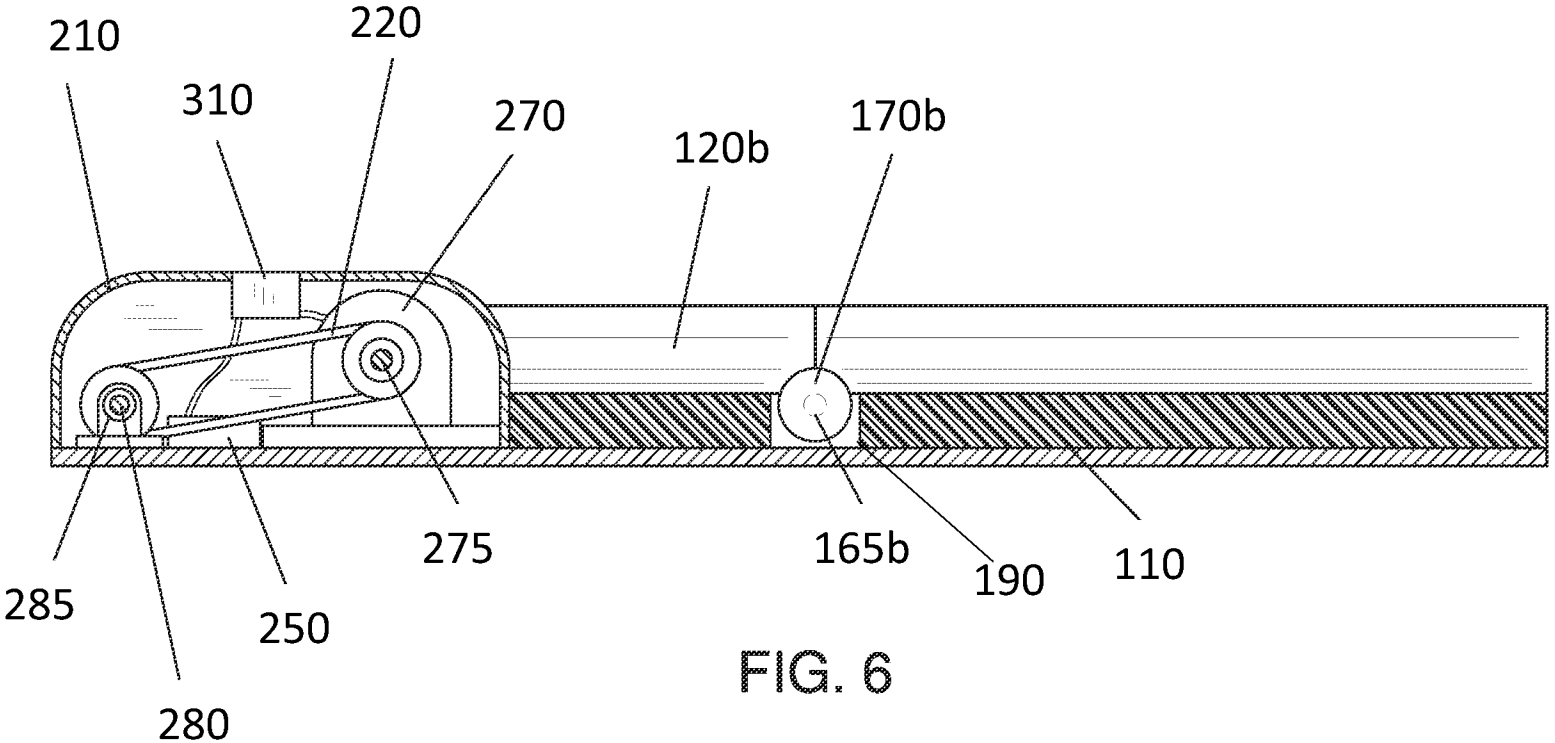
FIG. 6 is a side and cross sectional view of the leg portion of FIG. 1.

As shown in FIG. 6, the central motor 270 comprises a drive shaft 275, which is operatively connected to the hinge shaft 280 and/or a bearing 285 via a drive belt 220. The central motor 270 and/or the first hinge motor 170*a* and/or the second hinge motor 170*b* are operatively connected to a power source. As shown in FIG. 6, the power source may be a battery 250 housed in the housing 210.

The central motor 270, the first hinge motor 170*a*, and the second hinge motor 170*b* are operatively connected to a control panel 310. Control panels are well known to one of ordinary skill in the art. For example, the control panel may function to turn the motors 170, 270 on and off. Or, the control panel 310 may function to control the speed at which the hinge motors 170 pivot the portions of the half cylinders 120 and/or the speed at which the central motor 270 pivots the half cylinders with respect to the base 110. Or, the control panel 310 may function to control the how much pivoting occurs, for example regulating the height of the half cylinders 120 with respect to the base 110 and/or the positioning of the first and second portions of the half cylinders 120.

Figure 7:
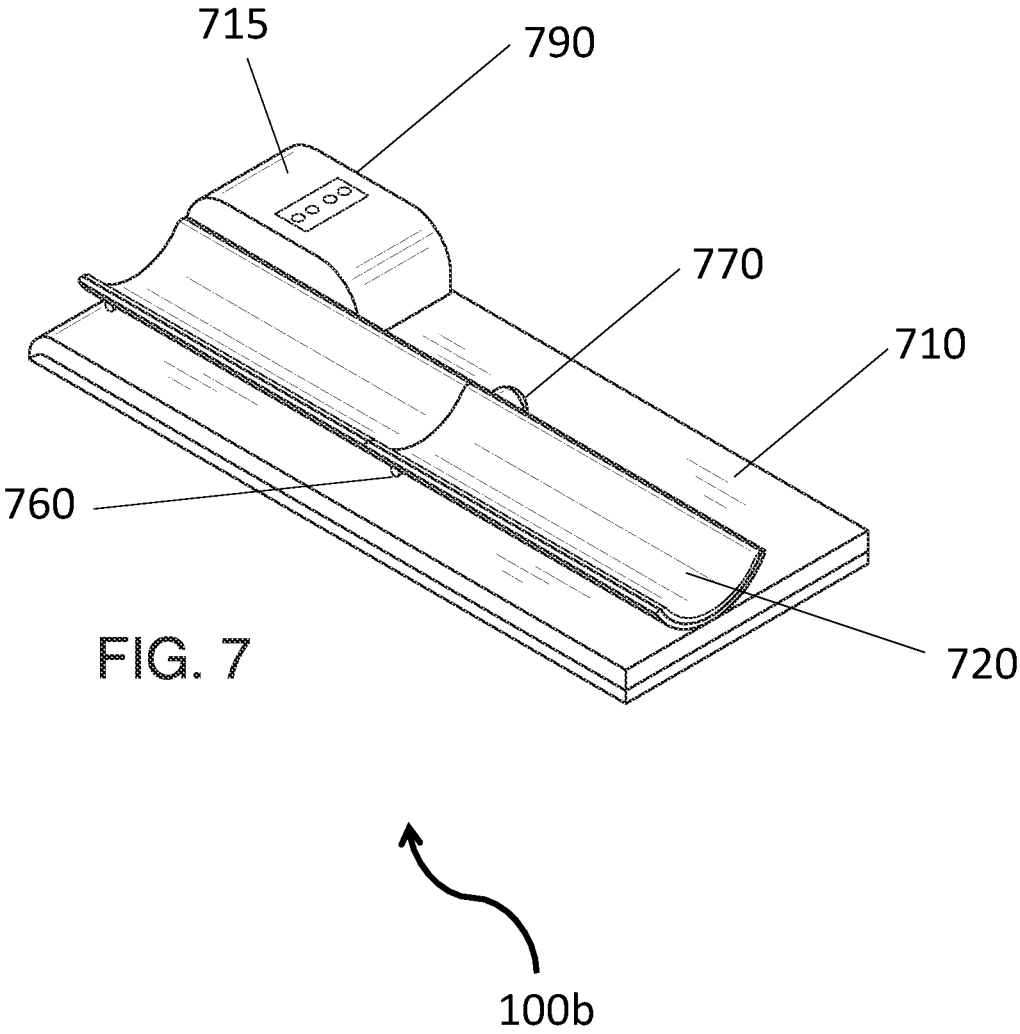
FIG. 7 is a perspective view of an arm portion of the physical therapy system of the present invention.

Referring now to FIG. 7, the arm portion 100*b* comprises a second base 710 having a top surface, a bottom surface, a first side edge, a second side edge opposite the first side edge, a third side edge, and a fourth side edge opposite the third side edge. Disposed on the top surface of the second base 720 is a third half cylinder 720. The third half cylinder 720 extends from near the third side edge to near the fourth side edge, for example the first end of the third half cylinder 720 is positioned near the third side edge. The third half cylinder 720 is adapted to cradle a user's arm.

The third half cylinder 720 is divided into a first portion and a second portion, the portions being pivotally connected via a fifth hinge 760.

In some embodiments, the fifth hinge 760 is positioned on the third half cylinder 720 such that the back surfaces of the portions of the third half cylinder 720 move away from each other. In some embodiments, the fifth hinge 760 is positioned on the third half cylinder 720 such that the back surfaces of the portions of the third half cylinder 720 move toward each other. Generally, a user places his/her arm in the third half cylinder 720 and positions his elbow over the fifth hinge 760. The pivoting of the third half cylinder 720 allows the user's arm to be bent at the elbow.

The fifth hinge 760 is operatively connected to a third hinge motor 770 (e.g., via a third hinge shaft). The third hinge motor 770 functions to pivot the third half cylinder 720 about the fifth hinge 760. In some embodiments, the fifth hinge 760 may be temporarily disposed in a slot disposed in the top surface of the second base 710. The slot may help keep the third half cylinder 720 flush with the second base 710 when not in use.

In some embodiments, the third half cylinder 720 is covered with a soft material, for example foam (e.g., dense foam, light foam), fabric, the like, or a combination thereof. The soft material can provide comfort to the user when placing his/her arm in the third half cylinder 720.

The first end of the third half cylinder 720 is pivotally attached to the second base 720 via a sixth hinge. The third half cylinder 720 can pivot upwardly and downwardly with respect to the second base 720 via the sixth hinge. The pivoting of the third half cylinder 720 about the sixth hinge is controlled via a second central motor.

The sixth hinge is connected to the second central motor via a second hinge shaft. The second hinge shaft is operatively connected to the second central motor. The second central motor is enclosed in a second housing 715. The third hinge motor 770 and/or the second central motor may be a standard motors or hydraulic motors. The present invention is not limited to standard and hydraulic motors.

In some embodiments, the second central motor comprises a drive shaft, which is operatively connected to the second hinge shaft and/or a bearing via a second drive belt. The second central motor and/or the third hinge motor 770 are operatively connected to a power source. In some embodiments, the power source is a battery housed in the second housing.

The second central motor and the third hinge motor 770 are operatively connected to a second control panel 790. The second control panel 790 may function to turn the second central motor and/or the third hinge motor 770 on and off. Or, the second control panel 790 may function to control the speed at which the third hinge motor 770 pivots the portions of the third half cylinder 720 and/or the speed at which the second central motor pivots the third half cylinder 720 with respect to the second base 720. Or, the second control panel 790 may function to control the how much pivoting occurs, for example regulating the height of the third half cylinder 720 with respect to the second base 720 and/or the positioning of the portions of the third half cylinder 720.

The present invention also features methods of performing physical therapy exercises. For example, to use the system 100 of the present invention, a user can obtain the leg portion 100*a* and/or one or two arm portions 100*b*. The user can arrange them on the floor as needed. The user can lie on his/her back or stomach and insert his/her legs and/or arms into the half cylinders. The user can manipulate the control panels to activate the movement and pivoting of the half cylinders.

Because the system of the present invention is divided into separate portions for the arms and legs, it is easy to be transported and stored.

The following the disclosures of the following U.S. Patents are incorporated in their entirety by reference herein: U.S. Pat. No. 1,098,326; U.S. Pat. Application No. 2005/0159683; U.S. Pat. No. 4,986,261; U.S. Pat. No. 4,566,440; U.S. Pat. No. 5,207,216; U.S. Pat. No. 6,821,288; U.S. Pat. Application No. 2006/0211957.

Various modifications of the invention, in addition to those described herein, will be apparent to those skilled in the art from the foregoing description. Such modifications are also intended to fall within the scope of the appended claims. Each reference, cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A physical therapy system comprising:

(a) a leg portion comprising:

(i) a first base having a top surface, a bottom surface, a first side edge, a second side edge opposite the first side edge, a third side edge, and a fourth side edge opposite the third side edge;

(ii) a first half cylinder disposed on the top surface of the first base, the first half cylinder is divided into a first portion and a second portion pivotally connected via a first hinge, the first hinge is positioned on the first half cylinder such that back surfaces of the first portion and the second portion move toward each other, wherein the back surfaces being able to directly rest on the top surface of the base;

(iii) a second half cylinder disposed on the top surface of the first base, the first half cylinder and the second half cylinder each function to cradle a leg of a user, wherein the second half cylinder is divided into a first portion and a second portion pivotally connected via a second hinge, the second hinge is positioned on the second half cylinder such that back surfaces of the first portion and the second portion move toward each other, wherein the back surfaces being able to directly rest on the top surface of the base;

(iv) a first hinge motor disposed immediately adjacent to and operatively connected to the first hinge and a second hinge motor disposed immediately adjacent to and operatively connected to the second hinge, the first hinge motor and the second hinge motor each function to pivot the first half cylinder and the second half cylinder about the first hinge and second hinge, respectively;

(v) a third hinge pivotally attaching a first end of the first half cylinder to the base, and a fourth hinge pivotally attaching a first end of the second half cylinder to the base; and (vi) a central motor operatively connected to the third hinge and the fourth hinge, the central motor functions to pivot the first half cylinder and the second half cylinder about the third hinge and fourth hinge, respectively, wherein upon rotation, the first portion and the second portion of each of the first half cylinder and the second half cylinder are disposed from off the top surface of the first base, wherein a terminating second edge of the first half cylinder extends out and away from the base, wherein a terminating second edge of the second half cylinder extends out and away from the base;

(b) at least one arm portion comprising:

(i) a second base having a top surface a bottom surface, a first side edge, a second side edge opposite the first side edge, a third side edge, and a fourth side edge opposite the third side edge;

(ii) a third half cylinder disposed on the top surface of the second base, the third half cylinder is adapted to cradle an arm of a user, wherein the third half cylinder is divided into a first portion and a second portion pivotally connected via a fifth hinge;

(iii) a third hinge motor operatively connected to the fifth hinge, the third hinge motor functions to pivot the third half cylinder about the fifth hinge;

(iv) a sixth hinge pivotally attaching a first end of the third half cylinder to the second base, wherein the third half cylinder can pivot upwardly and downwardly with respect to the second base via the sixth hinge; and (v) a second central motor operatively connected to the sixth hinge;

(c) a first control panel operatively connected to the central motor, the first hinge motor, and the second hinge motor, the first control panel functions to turn the central motor, the first hinge motor, and the second hinge motor on and off; and (d) a second control panel operatively connected to the second central motor and the third hinge motor, the second control panel functions to turn the second central motor or the third hinge motor on and off.

2. The physical therapy system of claim 1, wherein the first half cylinder and the second half cylinder are each covered with a soft material.

3. The physical therapy system of claim 2, wherein the soft material is a foam, a fabric, or a combination thereof.

4. The physical therapy system of claim 1, wherein the first hinge is operatively connected to the first hinge motor via a first hinge shaft.

5. The physical therapy system of claim 1, wherein the second hinge is operatively connected to the second hinge motor via a second hinge shaft.

6. The physical therapy system of claim 1, wherein the third hinge and fourth hinge are both connected to the central motor via a hinge shaft.

7. The physical therapy system of claim 1, wherein the central motor is enclosed in a housing.

8. The physical therapy system of claim 7, wherein the housing is positioned in between the first half cylinder and the second half cylinder.

9. The physical therapy system of claim 1, wherein the first hinge motor, the second hinge motor, or the central motor is a hydraulic motor.

10. The physical therapy system of claim 1, wherein the fifth hinge is operatively connected to the third hinge motor via a third hinge shaft.

11. The physical therapy system of claim 1, wherein the third half cylinder is covered with a soft material.

12. The physical therapy system of claim 11, wherein the soft material is a loam, a fabric, or a combination thereof.

13. The physical therapy system of claim 1, wherein the sixth hinge is connected to the second central motor via a second hinge shaft.

14. The physical therapy system of claim 1, wherein the first control panel functions to control a speed at which the first hinge motor, the second hinge motor, or the central motor rotates.

15. The physical therapy system of claim 1, wherein the second control panel functions to control a speed at which the third hinge motor or the second central motor rotates.

16. A physical therapy system consisting of:

(a) a leg portion consisting of:

(i) a first base having a top surface, a bottom surface, a first side edge, a second side edge opposite the first side edge, a third side edge, and a fourth side edge opposite the third side edge;

(ii) a first half cylinder disposed on the top surface of the first base, the first half cylinder is divided into a first portion and a second portion pivotally connected via a first hinge, the first hinge is positioned on the first half cylinder such that back surfaces of the first portion and the second portion move toward each other, wherein the back surfaces being able to directly rest on the top surface of the base;

(iii) a second half cylinder disposed on the to surface of the first base, the first half cylinder and the second half cylinder each function to cradle a leg of a user, wherein the second half cylinder is divided into a first portion and a second portion pivotally connected via a second hinge, the second hinge is positioned on the second half cylinder such that back surfaces of the first portion and the second portion move toward each other, wherein the back surfaces being able to directly rest on the top surface of the base;

(iv) a first hinge motor disposed immediately adjacent to and operatively connected to the first hinge and a second hinge motor disposed immediately adjacent to and operatively connected to the second hinge, the first hinge motor and the second hinge motor each function to pivot the first half cylinder and the second half cylinder about the first hinge and second hinge, respectively;

(v) a third hinge pivotally attaching a first end of the first half cylinder to the base, and a fourth hinge pivotally attaching a first end of the second half cylinder to the base; and (vi) a central motor operatively connected to the third hinge and the fourth hinge, the central motor functions to pivot the first half cylinder and the second half cylinder about the third hinge and fourth hinge, respectively, wherein upon rotation, the first portion and the second portion of each of the first half cylinder and the second half cylinder are disposed from off the top surface of the first base, wherein a terminating second edge of the first half cylinder extends out and away from the base, wherein a terminating second edge of the second half cylinder extends out and away from the base;

(b) at least one arm portion consisting of:

(i) a second base having a top surface, a bottom surface, a first side edge, a second side edge opposite the first side edge, a third side edge, and a fourth side edge opposite the third side edge;

(ii) a third half cylinder disposed on the top surface of the second base, the third half cylinder is adapted to cradle an arm of a user, wherein the third half cylinder is divided into a first portion and a second portion pivotally connected via a fifth hinge;

(iii) a third hinge motor operatively connected to the fifth hinge, the third hinge motor functions to pivot the third half cylinder about the fifth hinge;

(iv) a sixth hinge pivotally attaching a first end of the third half cylinder to the second base, wherein the third half cylinder can pivot upwardly and downwardly with respect to the second base via the sixth hinge; and (v) a second central motor operatively connected to the sixth hinge;

(c) a first control panel operatively connected to the central motor, the first hinge motor, and the second hinge motor, the first control panel functions to turn the central motor, the first hinge motor, and the second hinge motor on and off; and (d) a second control panel operatively connected to the second central motor and the third hinge motor, the second control panel functions to turn the second central motor or the third hinge motor on and off.

* * * * *